US005368984A

United States Patent [19]

Yoshida

[11] Patent Number: 5,368,984

[45] Date of Patent: Nov. 29, 1994

[54] SILVER HALIDE PHOTOGRAPHIC LIGHT-SENSITIVE MATERIAL

[75] Inventor: Kazuhiro Yoshida, Hino, Japan

[73] Assignee: Konica Corporation, Japan

[21] Appl. No.: 150,423

[22] Filed: Nov. 10, 1993

[30] Foreign Application Priority Data

Nov. 13, 1992 [JP] Japan ..... 4-303896

[51] Int. Cl.[5] ..... G03C 1/06

[52] U.S. Cl. ..... 430/264; 430/598; 430/613; 430/614; 430/627; 430/628; 430/539; 430/536; 430/642

[58] Field of Search ..... 430/264, 598, 613, 614, 430/627, 628, 539, 536, 642

[56] References Cited

U.S. PATENT DOCUMENTS

| | | | |
|---|---|---|---|
| 2,831,767 | 4/1958 | Dann et al. | 430/628 |
| 4,684,604 | 8/1987 | Harder | 430/375 |
| 5,004,669 | 4/1991 | Yamada et al. | 430/264 |
| 5,187,042 | 2/1993 | Katoh et al. | 430/264 |
| 5,230,983 | 7/1993 | Inoue et al. | 430/264 |
| 5,238,780 | 8/1993 | Takagi et al. | 430/264 |
| 5,238,800 | 8/1993 | Hosoi et al. | 430/264 |
| 5,273,859 | 12/1993 | Katoh et al. | 430/264 |

FOREIGN PATENT DOCUMENTS

| | | |
|---|---|---|
| 0477670 | 4/1992 | European Pat. Off. . |
| 512420 | 11/1992 | European Pat. Off. . |

*Primary Examiner*—Thomas R. Neville
*Attorney, Agent, or Firm*—Jordan B. Bierman

[57] ABSTRACT

A silver halide photographic light-sensitive material is disclosed. The material comprises a light-sensitive silver halide emulsion layer and containing both of a latex stabilized by gelatin and a redox compound from which a development inhibitor is released when the redox is oxidized in the emulsion layer or other non-light-sensitive hydrophilic colloidal layer. The silver halide photographic light-sensitive material is suitable for graphic arts plate-making use and is excellent in Ming-Gothic type reproduction, screen-image enlarging and screen-image reduction aptitudes, white-on-color letter quality, paste-up trace prevention, easy handling and stability.

4 Claims, 1 Drawing Sheet

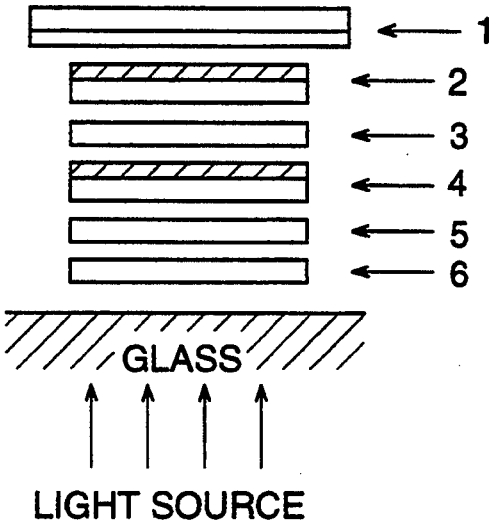
1
2
3
4
5
6
GLASS
LIGHT SOURCE

SILVER HALIDE PHOTOGRAPHIC LIGHT-SENSITIVE MATERIAL

FIELD OF THE INVENTION

This invention relates to a silver halide photographic light-sensitive material for graphic arts plate-making use and, particularly, to a silver halide photographic light-sensitive material for graphic arts plate-making use which is excellent in screen-image enlarging aptitude, white-on-color letter quality and paste-up trace prevention.

BACKGROUND OF THE INVENTION

A photographic plate-making process, in which a silver halide photographic light-sensitive material is used, include, for example, a step for converting a continuous-tone original into a halftone dot image, that is, a step for converting a continuous gradation density variation into an aggregate of halftone dots having an area proportionate to the density, and another step for converting the halftone dot image obtained in the above-mentioned step into a halftone dot image having more excellent sharpness, that is, a contact step.

It is inevitable that the light-sensitive material applicable to these steps is to have a high contrast, because an excellent halftone dot quality is required.

As for the processes for obtaining the above-mentioned characteristics, there has been a well-known process in which a light-sensitive material comprising a silver chlorobromide emulsion having relatively fine grains, a narrow grain-size distribution and a high silver chloride content, such light-sensitive material is processed by an alkaline hydroquinone developer having an extremely low sulfurous acid ion concentration, that is so-called a lith development process.

When the process is used, however, there has raised such a defect that a preservability is seriously deteriorated, because a sulfurous acid ion concentration has been low in a developer and a development speed has been slowed down, because a single hydroquinone developing agent is used, so that a rapid processing has not been achieved.

Accordingly, there has been a demand for the development of a novel light-sensitive material capable of providing a high contrast when processing it with a so-called PQ or MQ type developer, which contains a developing agent having an excellent preservability, a rapid processability and a super additive property and a sulfurous acid salt having a relatively high concentration. As for the novel light-sensitive materials, the silver halide photographic light-sensitive materials each containing a tetrazolium compound are disclosed in, for example, Japanese Patent Publication Nos. 59-17825/1984, 59-17818/1984, 59-17819/1984, 59-17820/1984, 59-17821/1984, 59-17826/1984 and 59-17822/1984.

On the other hand, the processes for rapidly obtaining a high contrast image based on the other principles are disclosed as cited in, for example, U.S. Pat. Nos. 2,419,975 and 4,224,401 and Japanese Patent Publication Open to Public Inspection (hereinafter referred to as JP OPI Publication) Nos. 51-16623/1976 and 51-20921/1976; and the silver halide photographic light-sensitive materials each containing a hydrazine compound are disclosed as cited in, for example, U.S. Pat. Nos. 2,419,975 and 4,224,401 and JP OPI Publication Nos. 51-16623/1976 and 51-20921/1976.

On the other hand, however, such a hard contrast light-sensitive material as mentioned above has a defect that a letter reproducibility is deteriorated when a line image is photographed. To be more concrete, in the case where, for example, an original with a mixture of 7-point Ming type and Gothic types is exposed to light through a photographic process camera and when the fine line of the Ming type is exposed to light so as not to be defaced, the background density which should be defaced in black is lowered to increase pin-holes and the line width of Gothic type is made fine without thickening to a desired Gothic type thickness. On the contrary, when an exposure quantity is adjusted to meet the line width of Gothic type, the fine line of Ming type is defaced. In the printing and print-making industry, therefore, there uses such a process that Ming type and Gothic type are separately photographed and then to synthesize the two in the post processing step. In this process, however, the labor and material are required double or more.

Also in an operation for enlarging or reducing an original converted into halftone dots, that is so-called a screen-image enlarging, there is a problem that a halftone dot range is clogged when a hard contrast light-sensitive material is used. Therefore, for a screen-image enlarging, an exposure is usually made through a so-called Lee filter. However, there also raises a problem, because a filter has to be attached and detached every time when making an exposure and a finished quality is varied by the deterioration of the filter used.

Recently, a silver halide photographic light-sensitive material so stable and operationally efficient as to be handled by any amateur has been demanded, due to the shortage of labor force especially including skilled workers and the increase of unskilled workers.

As described in JP OPI Publication No. 3-290644/1991, there has been an increasing necessity for a silver halide photographic light-sensitive material better in the enlargement or reduction of a screen-image and in Ming type-Gothic type reproduction aptitude and further better in white-on-color letter quality, paste-up trace prevention and, besides, pin-hole prevention.

SUMMARY OF THE INVENTION

Taking the above-mentioned problems into consideration, it is an object of the invention to provide a silver halide photographic light-sensitive material for graphic arts plate-making use excellent in Ming type-Gothic type reproduction, screen-image reduction aptitude, white-on-color letter quality, paste-up trace prevention, as well as excellent in easy handling and stability.

The silver halide photographic light-sensitive material of the invention comprises a support and a light-sensitive silver halide emulsion layer; and the silver halide photographic light-sensitive material contains both of a latex stabilized by gelatin and a redox compound from which a development inhibitor is released when the redox compound is oxidized in the emulsion layer or other non-light-sensitive hydrophilic colloidal layer.

The latex stabilized by gelatin is prepared synthesizing polymer latex from monomers in the presense of gelatin during or after the synthesizing polymer latex.

BRIEF DESCRIPTION OF THE DRAWING

FIG. 1 is an illustration of an evaluation method of a paste-up trace.

DETAILED DISCLOSURE OF THE INVENTION

A characteristic of the polymer latex stabilized by gelatin in the present invention is that the surface and/or the inside of the polymer latex is dispersed and stabilized by gelatin. It is preferable that the polymer which constitutes the latex and gelatin have some kind of bond, and in this case, the polymer and the gelatin can bond directly or bond by a crosslinking agent.

The polymer latex stabilized by the gelatin of the present invention can be obtained by adding the gelatin solution to a reaction system to be reacted during or after the polymerization reaction of the polymer latex. It is preferable to react polymer latex synthesized in the surfactant with gelatin by using a crosslinking agent. The latex can also be obtained by the presence of gelatin during polymerization reaction of the polymer, and it is more preferable than the above-mentioned method. It is preferable not to use surfactant during the polymerization reaction of the polymer. When the surfactant is used, the addition amount is between 0.1 and 3.0%, and preferably between 0.1 and 1.5%, to the polymer element by weight.

The ratio of the gelatin and the polymer during synthesis is preferably between 1:100 and 2:1, and more preferably between 1:50 and 1:2 by weight.

The average particle size of the polymer latex stabilized by gelatin is preferably between 0.005 and 1 μm, and more preferably between 0.02 and 0.5 μm.

The polymer latex stabilized by the gelatin of the present invention includes hydrates of such vinyl polymers as acrylic acid ester, methacrylate acid ester and styrene, described, for instance, in U.S. Pat. Nos. 2,772,166, 3,325,286, 3,411,911, 3,311,912, 3,525,620, and Research Disclosure No. 195 19551 (July, 1980).

The polymer latex part of the polymer latex stabilized by gelatin preferably used for the present invention includes homopolymer of metaalkylacrylates, such as methylmethacrylate and ethylmethacrylate, or homopolymer of styrene, copolymer of metaalkylacrylate or styrene, and acrylic acid, N-methylol-acrylamide or glycidolmethacrylate; homopolymer of alkylacrylates such as methylacrylate, ethylacrylate and butylacrylate, copolymer of alkylacrylate and acrylic acid or N-methylol-acrylamide (preferably, the copolymerization element of acrylic acids is up to 30% by weight); homopolymer of butadiene, copolymer of butadiene and at least one of styrene, buthoxy-methylacrylic amide or acrylic acid; and ternary copolymer of vinylidene chloride-methylacrylate-acrylic acid.

When the gelatin is bonded using a crosslinking agent, it is preferable that the monomer which constitutes the polymer latex includes a carboxyl group, an amino group, an amide group, an epoxy group, a hydroxyl group, an aldehyde group, an oxazoline group, an ether group, an active ester group, a methylol group, a cyano group, an acetyl group and a reactive group such as unsaturated carbon bond. The crosslinking agent may be one usually used for gelatin such as an aldehyde type, a glycol type, a triazine type, an epoxy type, a vinyl sulfone type, an oxazoline type, a methacrylate type and an acrylic type. The 2-acrylic amide-2-methylpropane sulfonic acid or its salt may be used as a monomer which constitutes polymer latex to enhance the dispersion stability of the polymer latex stabilized by the gelatin of the present invention. The added amount of the above-mentioned monomer is preferably 0.5 to 20% by weight of the total weight in the constitutional element.

The lime processed gelatin and the acid-processed gelatin described in page 30 of Bull. Soc. Sci. Phot. Japan No. 16 (1966) may be used, and the hydrolysis product and the enzyme degradation product of the gelatin may also be used. The gelatin derivative can be obtained by reacting the gelatin with various kinds of compounds such as acid halide, acid anhydride, isocyanates, bromo acetic acid, alkane sultones, vinylsulfon amides, maleinimide compounds, polyalkylene oxides and epoxy compounds. The specific examples are described in U.S. Pat. Nos. 2,614,928, 3,132,945, 3,186,846 and 3,312,553, British Patent Nos. 861,414, 1,033,189 and 1,005,784, and Japanese Patent Examined Publication No. 42-26845.

An albumin and a casein as the protein, a hydroxyethylcellulose, a carboxymethylcellulose and a sulfate of cellulose as the cellulose derivative, and an algln acid soda and a starch derivative as the sugar derivative may be used with the gelatin.

The polymer latex stabilized by the gelatin used for the present invention may be added to at least one hydrophilic colloidal layer. It is preferable to be added to both the light-sensitive hydrophilic colloidal layer and the non-light-sensitive hydrophilic colloidal layer on the side of a light-sensitive hydrophilic colloidal layer. It may be comprised either on one side of the support or both sides. It has been proven that the effect of dimensional stability is remarkably enhanced when the added amount of the latex of the invention is not less than 30%, and preferably between 30% and 200%, to the gelatin in each hydrophilic colloidal layer by weight. A conventional latex can be added to a layer to which the latex of the present invention is added and/or is not added. When on both sides of the support, the kind and/or the amount of the polymer latex of each side may either be the same or different.

Examples of the polymer latex for the use of the polymer latex stabilized by the gelatin of the invention are shown. In the actual latex gelatin molecule seems to link to a part of the monomer component of the polymer.

L-1

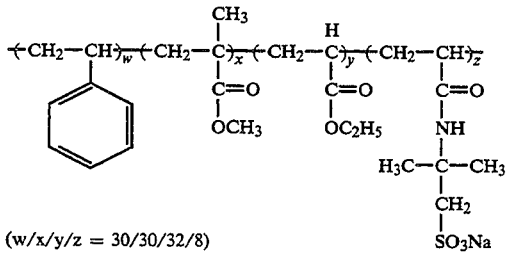

(w/x/y/z = 30/30/32/8)

L-2

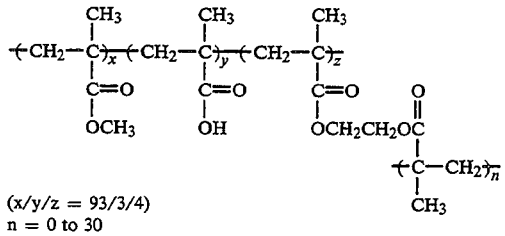

(x/y/z = 93/3/4)
n = 0 to 30

-continued

L-3

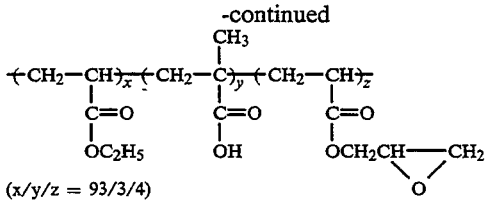

(x/y/z = 93/3/4)

L-4

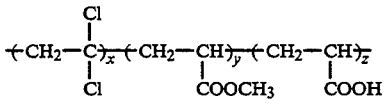

(x/y/z = 85/13/2)

L-5

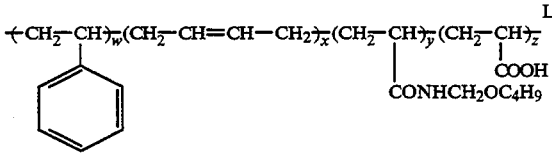

(w/x/y/z = 63/32/3/2)

L-6

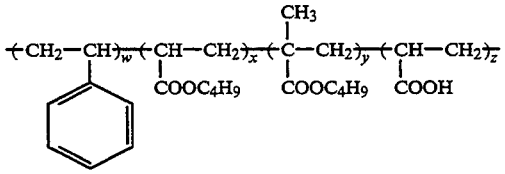

(w/x/y/z = 45/43/8/4)

L-7

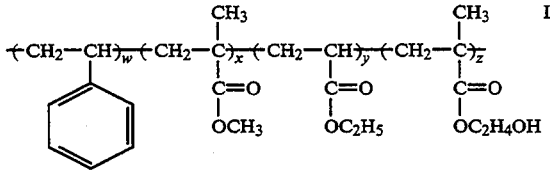

(w/x/y/z = 30/30/32/8)

<Preparation examples of Latex stabilized by gelatin>

Preparation of stabilized latex by gelatin L-1.

Gelatin in an amount of 1.0 Kg, 0.01 Kg of sodium dodecylbenzene sulfonate and 0.05 Kg of ammonium persulfate were added to 60 liters of water. 3.0 Kg of styrene, 3.0 Kg of methylmethacrylate, 3.2 Kg of mixture of ethylacrylate and 0.8 Kg of sodium salt of 2-acrylic amido-2-methylpropane sulfonic acid were added to the above-mentioned solution stirring for an hour at a solution temperature of 60° C. under the nitrogen circumstance. The solution was stirred for another 1.5 hours and the remaining monomer was removed by steam distillation for an hour. After being cooled down to room temperature, pH was adjusted to 6.0 by using ammonia. Water was added to the obtained latex solution to make a quantity of 75 Kg, and the monodispersed latex of an average particle size of 0.11 μm was obtained.

This is an example of preparation that gelatin is reacted during the synthesis of polymer latex.

Preparation of stabilized latex by gelatin L-3.

Sodium dodecylbenzene sulfonate in an amount of 0.01 Kg and 0.05 Kg of ammonium persulfate were added to 40 liters of water. 9.3 Kg of ethylacrylate, 0.4 Kg of the reactant of epichlorohydrin and acrylic acid and 0.3 Kg of the mixture of acrylic acid were added to the above-mentioned solution stirring for an hour at a solution temperature of 80° C. under the nitrogen circumstance, and stirred for another 1.5 hours. Then, 1.0 Kg of gelatin and 0.005 Kg of ammonium persulfate were added and the solution was stirred for 1.5 hours. After reaction, the remaining monomer was removed by steam distillation for an hour. It was cooled down to room temperature, and pH was adjusted to 6.0 by using ammonia. Water was added to the obtained latex solution to make a quantity of 55 Kg, and the monodispersed latex with an average particle size of 0.12 μm was obtained.

This is an example of preparation that gelatin is reacted after the synthesis of polymer latex.

The details and examples of the polymer latex stabilized by gelatin are also described in, for example, JP OPI Publication No. 5-224328/1993 and USP 5,066,572.

For a redox compound from which a development inhibitor can be released by oxidizing the redox compound, which may preferably be used in the invention, the compounds described in, for example, JP OPI Publication No. 4-5652/1992, pp. (7) to (14) can be used.

Preferable redox compound are described below. The preferable compounds are represented by formulae R-I, R-II or R-III.

R-I

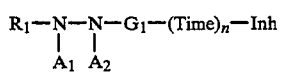

R-II

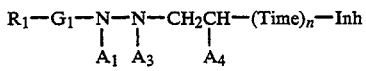

R-III

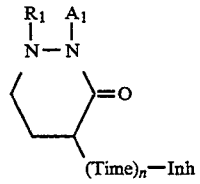

In the formulae, $R_1$ is an aliphatic or aromatic group, $G_1$ is

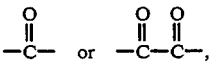

$A_1$ and $A_2$ are independently a hydrogen atom, an alkylsulfonyl, arylsulfonyl or acyl group which may be substituted, and at least one of $A_1$ and $A_2$ is a hydrogen atom. $A_3$ is a hydrogen atom, an alkylsulfonyl, arylsulfonyl or acyl group which may be substituted, or a group

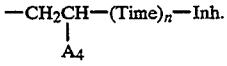

$A_4$ is a nitro, cyano, carboxy sulfo group or $-G_1-R_1$. "Time" is a two valent linkage group, n is an integer of 0 or 1, "Inh" is a group that becomes an development inhibitor when released from the compound during development process.

The group "Time" is a group releasing the group "Inh" by one or more step of reactions such as a redox reaction or an alkali hydrolysis reaction when the group -(Time)-Inh is released from the compound during the development process. The group "Time" may have a timing adjusting function to release the inhibitor.

The aliphatic group for $R_1$ is an alkyl group having carbon atom numbers of 1 to 30, preferably 1 to 20. The alkyl group may be a straight, branched or cyclic one, and may have a substituent(s). The aromatic group for $R_1$ is a single or fused aryl group or unsaturated heterocycle group, both of which may have a substituent(s).

Examples of the inhibitor to be released includes benzotriazoles, nitrobenzotriazoles, and phenylmercaptotetrazoles.

Examples of the compound are listed.

R-1

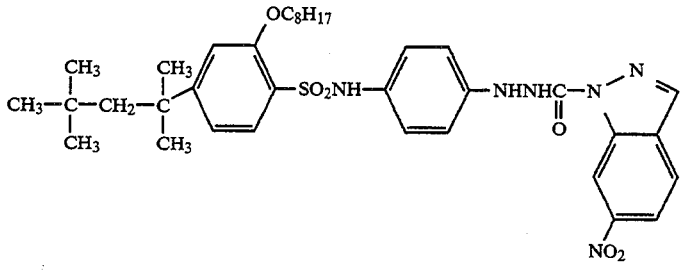

R-2

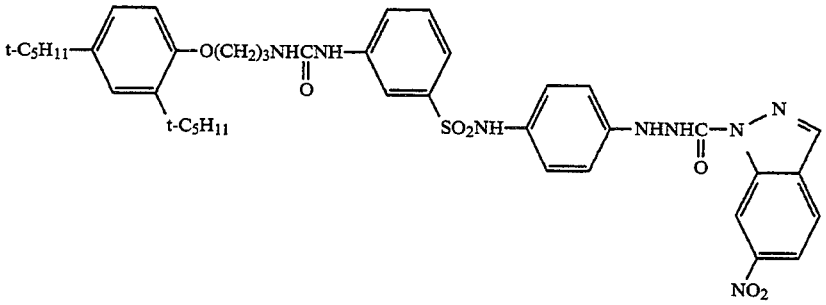

R-3

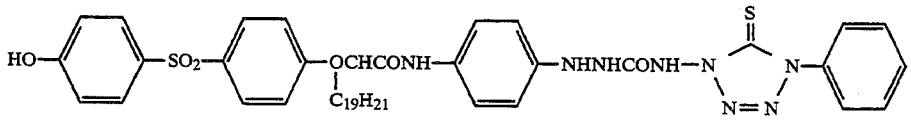

R-4

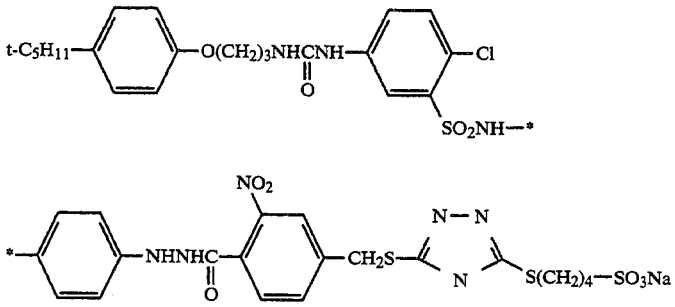

R-5

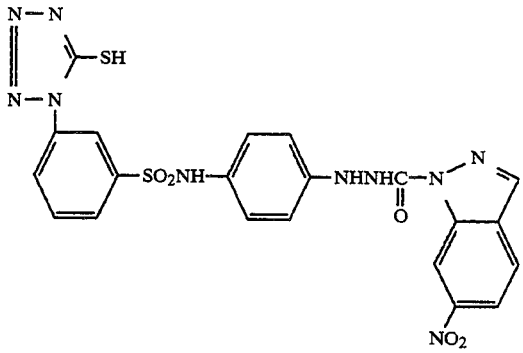

-continued

R-6

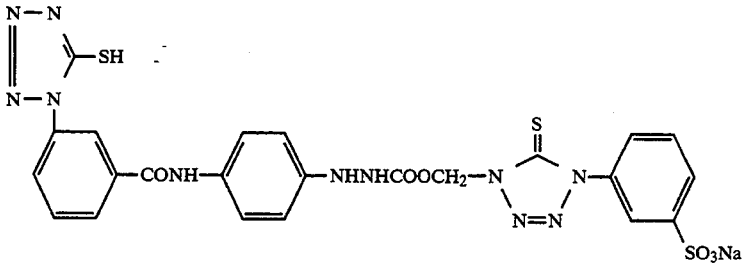

R-7

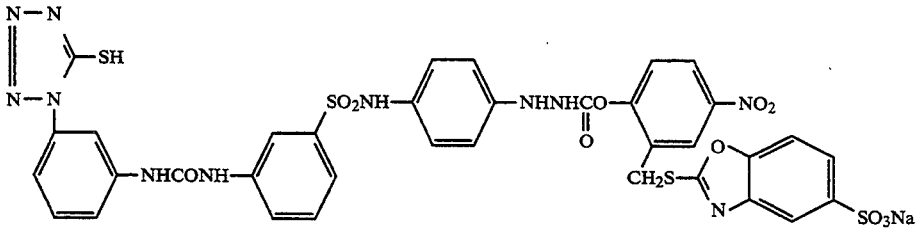

R-8

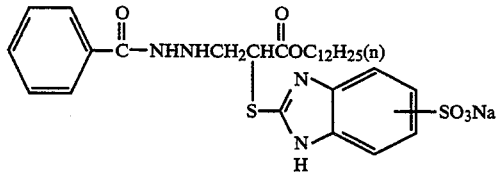

R-9

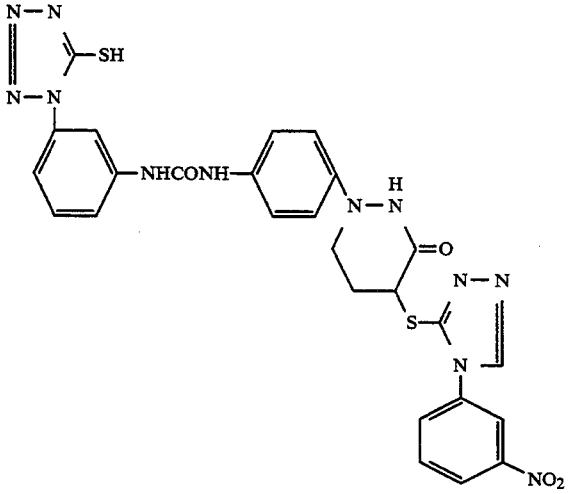

The compound is synthesized according to, for example, U.S. Pat. No. 4,684,604. The mechnism of the redox reaction in the develpping prpcess is also described in U.S. Pat. No. 4,684,604.

The compound is used in an amount of $10^{-6}$ to $10^{-2}$ mol per 1 mol of silver halide, or $10^{-7}$ to $10^{-3}$ mol per 1 $m^2$ of the photographic material.

The compound is added to a hydrophilic layer composing the silver halide photographic material, for example, a light sensitive silver halide emulsion layer, a non-light sensitive silver halide emulsion layer, an inter layer or protect layer. The compound is preferably added in the light sensitive silver halide emulsion layer or the non-light sensitive silver halide emulsion layer, and most preferably in the non-light sensitive silver halide emulsion layer provided on the light sensitive silver halide emulsion layer, interposing an inter layer as demand. The inter layer is provided between the layers to have a thickness of 0.1 to 5.0, preferably 0.2 to 1 μm made of hydrophilic polymer such as gelatin. The compound is dissolved in a water miscible organic solvent, for example, alcohols such as methanol, ethanol or fluorinated alcohol, ketones such as acetone or methylethylketone, or methylcellosolve, and added into the silver halide photographic material. The compound may be finely dispersed in oil such as tricredilphosphate or dibutylphthalate, and added into the photographic material.

To a silver halide photographic light-sensitive material of the invention, a hydrazine derivative and a tetrazolium compound may be applicable as a contrast hardener.

The hydrazine derivatives are preferably represented by the following Formula (H).

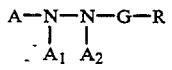

Formula (H)

wherein A represents an aryl group or a heterocyclic group containing at least one sulfur or oxygen atom; G represents $-(CO)_n-$ group, a sulfonyl group, a sulfoxy group,

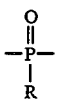

group or an iminomethylene group; n is an integer of 1 or 2; $A_1$ and $A_2$ represent each a hydrogen atom or a hydrogen atom for one and a substituted or unsubstituted alkylsulfonyl or acyl group for the other; R represents a hydrogen atom, or an alkyl, aryl, alkoxy, aryloxy, amino, carbamoyl, oxycarbonyl or $-O-R_4$ group in which $R_4$ represents an alkyl or saturated heterocyclic group.

For the above-mentioned hydrazine derivatives, those detailed in, for example, JP OPI Publication. No. 5-224330/1993 may be used.

Examples of the hydrazine compound are listed.

H-1

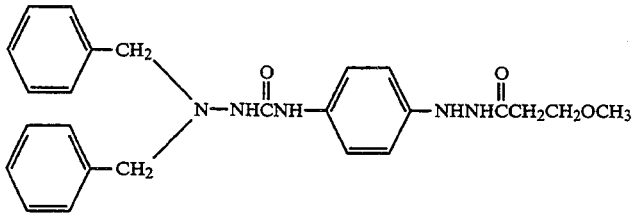

H-2

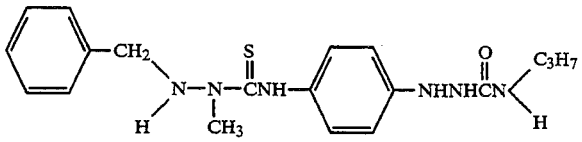

H-3

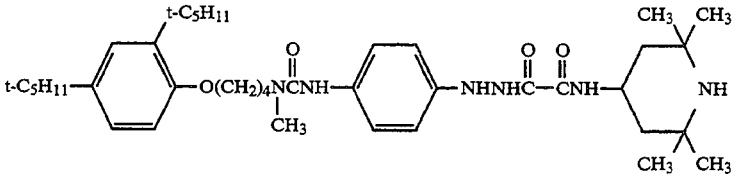

H-4

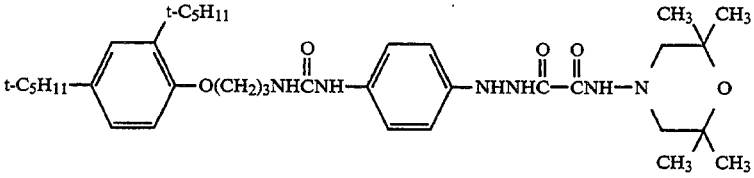

H-5

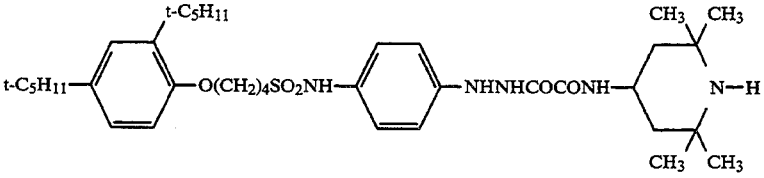

H-6

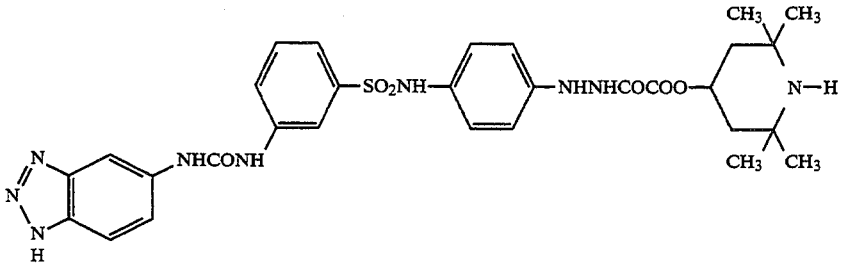

The tetrazolium compounds include, preferably those represented by the following Formula (T).

Formula (T)

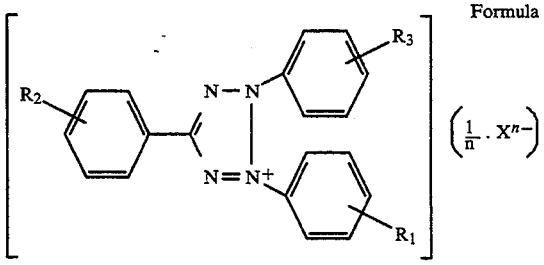

wherein substituents $R_1$, $R_2$ and $R_3$ of the phenyl group of a triphenyl tetrazolium compound represent each a hydrogen atom or a substituent. The substituent preferably has an electron withdrawing degree indicated by a negative sigma value (sP) in Hammett's rule.

X is an anion, whose example includes halogen ion such as chlorium, bromium and iodium, acid radical of inorganic acid such as nitric acid, sulfuric acid and perchloric acid, acid radical of organic acid such as sulphonic acid and carbonic acid, anionic surfactant, for example, lower alkylbenzensulfonic acid anion such as p-toluensulfonic acid anion, higher alkylbenzensulfonic acid anion such as p-dodecylbenzensulfonic acid anion, higher alkyl sulfateester anion such as laurilsulfate anion, tetraphenylboron, di-2-ethylhexylsulfosuccsinate anion, cetylpolyethenoxysulfate anion, stearic acid anion and polyacrilic acd. The preferable anion is chlomium ion. n is an integer corresponding to the valency of the anion X, for example, n=1 for halogen ion and n=2 for sulfate ion.

Examples of the compound is listed.

T-1

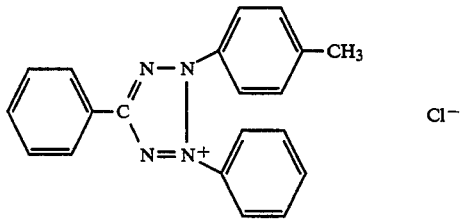

T-2

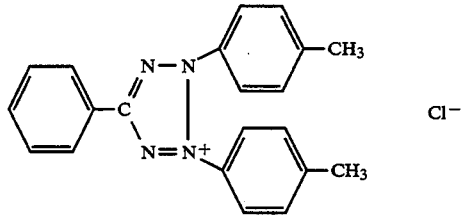

T-3

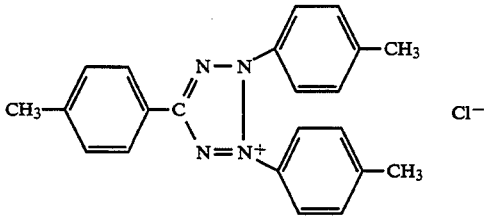

-continued

T-4

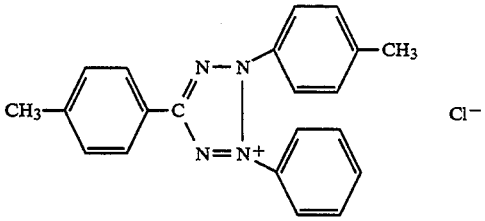

T-5

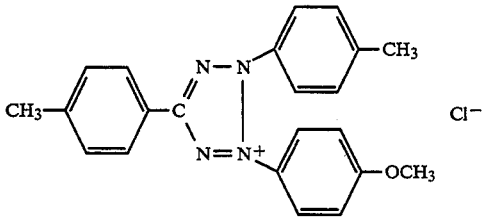

T-6

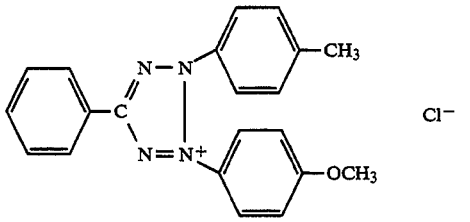

T-7

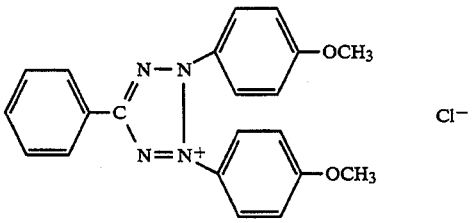

For the tetrazolium compounds, those detailed in, for example, JP OPI Publication No. 3-44635/1991, pp. (15)-(16) may be used.

A process such as a development can be carried out in various methods commonly applicable to the processes of silver halide photographic light-sensitive materials, of which are well-known in the art.

Further to the gelatin used to stabilize the latex of the present invention it is possible to use, in combination, a hydrophilic colloid such as grafted polymer of gelatin, other protein than gelatin, sugar derivative, cellulose derivative and synthetic hydrophilic high polymer material such as a homopolymer or copolymer.

EXAMPLES

Now, the effects of the invention will be concretely exemplified with reference to the following examples.

EXAMPLE 1

(Preparation of Support having a Conductive Layer)

A 100 μm-thick subbed polyethylene terephthalate film base was corona-discharged by an energy of 8 W/(m2 min) and was then coated thereon by an antistatic solution having the following composition at a coating speed of 70 m/min by making use of a roll-fit coating pan and an air-knife so as to have the following amount coated.

| | |
|---|---|
| Water-soluble conductive polymer P | 0.6 g/m$^2$ |
| Hydrophobic polymer particle L | 0.4 g/m$^2$ |
| Polyethylene oxide compound Ao | 0.06 g/m$^2$ |
| Hardener E | 0.2 g/m$^2$ |

The resulting conductive layer-coated support was dried at 90° C. for 2 minutes and was then heat-treated at 140° C. for 90 seconds. In the above-mentioned manner, a support coated with a conductive layer on one side thereof was prepared.

Polymer P

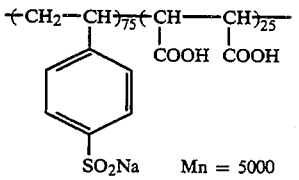

Mn = 5000

Polymer L

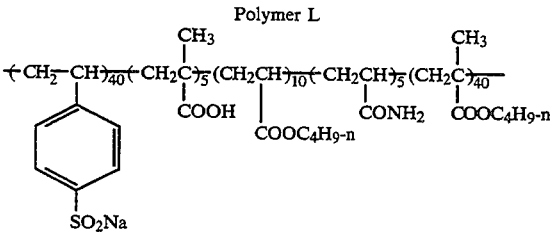

-continued

Compound Ao $HO(CH_2CH_2O)_{15}H$

E

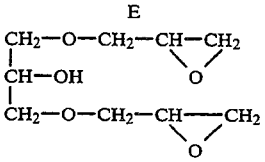

(Preparation of Silver Halide Photographic Emulsion A)

A silver iodobromide emulsion (having a silver iodide content of 2 mol % per mol of silver) was prepared in a double-jet precipitation method. In carrying out the precipitation, $K_2IrCl_6$ was added in an amount of $8\times10^{-7}$ mols per mol of silver. The resulting emulsion was proved to be an emulsion comprising cubic-shaped monodisperse type grains having an average grain size of 0.20 μm (in a variation coefficient of 9%). The emulsion was washed and desalted in common methods. The pAg thereof at 40° C. was proved to be 8.0. Successively, sensitizing dyes D-1 and D-2 were added in an amount of 200 mg and 10 mg each per mol of silver, respectively, and further a mixture of compounds (A), (B) and (C) was then added in an amount of 30 mg/mol of silver, so that Emulsion A was prepared.

After that, Emulsion A was sulfur-sensitized.

(A) (B) (C)

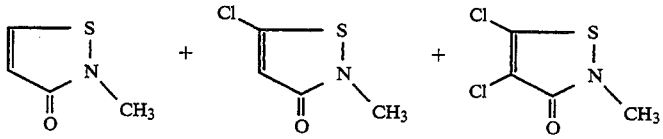

Sensitizing dye D-1

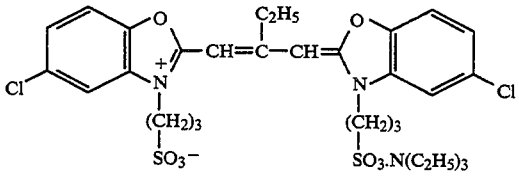

Sensitizing dye D-2

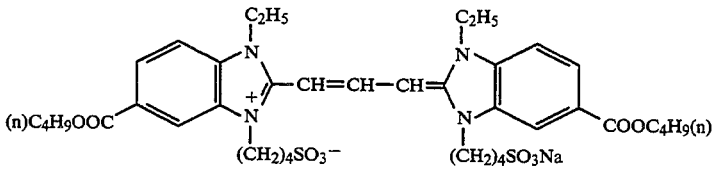

Chemical Formula (1) (Composition of Light-sensitive Silver Halide Emulsion Layer)

| | |
|---|---|
| Gelatin | 1.3 g/m$^2$ |
| Silver halide emulsion A | 3.2 g/m$^2$ (in silver content) |
| Stabilizer: 4-methyl-6-hydroxy-1,3,3a,7-tetrazaindene | 30 mg/m$^2$ |
| Antifoggants: | |
| 5-nitroindazole | 10 mg/m$^2$ |
| 1-phenyl-5-mercaptotetrazole | 5 mg/m$^2$ |
| Surfactant: Sodium dodecylbenzenesulfonate | 0.1 g/m$^2$ |
| Nucleation accelerator N-1 | 40 mg/m$^2$ |
| N-1 | |

-continued

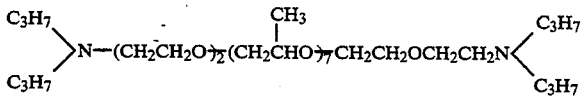

| | |
|---|---|
| Hydrazine derivative | $7 \times 10^{-5}$ mols/m$^2$ (See Table 1) |
| Comparative Latex A | 1 g/m$^2$ |
| Polyethylene glycol (having a molecular weight of 4000) | 0.1 g/m$^2$ |
| Layer hardener HA-1 | 60 mg/m$^2$ |

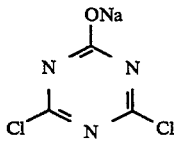

Chemical Formula (2) (Composition of Emulsion Protective Layer)

| | |
|---|---|
| Gelatin | 0.7 g/m$^2$ |
| Surfactants: | |
| S-2 | 10 mg/m$^2$ |

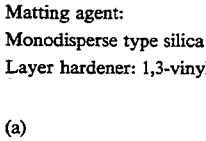

| | |
|---|---|
| S-3 | 5 mg/m$^2$ |

| | |
|---|---|
| Matting agent: Monodisperse type silica having an average particle size of 3.5 μm | 3 mg/m$^2$ |
| Layer hardener: 1,3-vinylsulfonyl-2-propanol | 40 mg/m$^2$ |

Chemical Formula (5) (Composition of Backing Layer)

(a)

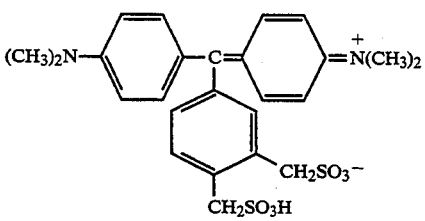

30 mg/m$^2$ (b)

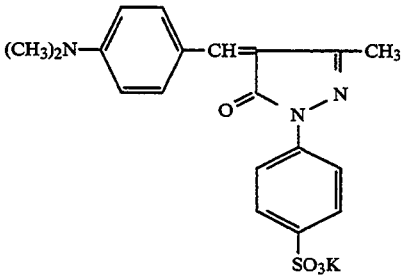

75 mg/m$^2$ (c)

-continued

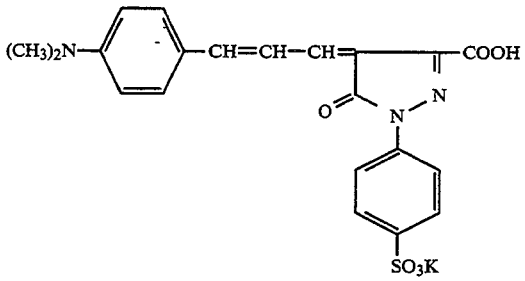

30 mg/m²

| | |
|---|---|
| Gelatin | 2.4 g/m² |
| Surfactants: | |
| Sodium dodecylbenzenesulfonate | 0.1 g/m² |
| S-1 | 6 mg/m² |

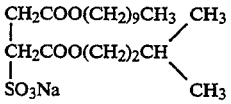

| | |
|---|---|
| Colloidal silica | 100 mg/m² |
| Layer hardener: E | 50 mg/m² |
| Layer hardener: E | 55 mg/m² |

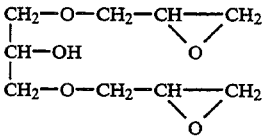

Chemical Formula (6) (Composition of Backing Protective Layer)

| | |
|---|---|
| Gelatin | 1 g/m² |
| Matting agent: Monodisperse polymethyl methacrylate having an average particle size of 5.0 μm | 50 mg/m² |
| Surfactant: S-2 | 10 mg/m² |
| Layer hardener: Glyoxal | 25 mg/m² |
| Latex A | 0.5 g/m² |

Chemical Formula (3) (Composition of Hydrophilic Colloidal Layer 1)

| | |
|---|---|
| Gelatin | 0.5 g/m² |
| Surfactant: S-1 | 9 mg/m² |

Chemical Formula (4) (Composition of Hydrophilic Colloidal Layer 2)

| | |
|---|---|
| Gelatin | 0.5 g/m² |
| Silver halide emulsion A (Not light-sensitive) | 0.3 g/m² |
| Stabilizer: 4-methyl-6-hydroxy-1,3,3a,7-tetrazaindene | 30 mg/m² |
| Antifoggants: | |
| 5-nitroindazole | 10 mg/m² |
| 1-phenyl-5-mercaptotetrazole | 5 mg/m² |
| Surfactant: S-1 | 10 mg/m² |
| Redox compound of the invention | $3.0 \times 10^{-5}$ mols/m² |

(Synthesis of Latex A for comparison)

Latex A is prepared without using gelatin and monomer component is identical with latex stabilized with gelatin L-1.

Sodium dodecylbenzene sulfonate in an amount of 0.01 Kg and 0.05 Kg of ammonium persulfate were added to 40 liters of water. 3.0 Kg of styrene, 3.0 Kg of methylmethacrylate, 3.2 Kg of ethylacrylate and 0.8 Kg of 2-acrylic amido-2-methylpropane sulfonic acid were added to the above-mentioned solution stirring for an hour at a solution temperature of 60° C. under the nitrogen circumstance. The solution was stirred for another 1.5 hours and the remaining monomer was removed by steam distillation for an hour. After being cooled down to room temperature, pH was adjusted to 6.0 using sodium hydroxide. Water was added to the obtained latex solution to make a quantity of 55 Kg, and a monodispersed latex with an average particle size of 0.11 μm was obtained.

On a support coated thereon with a conductive layer, the following layers were each coated in the following order on the opposite side of the conductive layer. On the conductive layer side thereof, a backing layer having Formula (5) and a backing protective layer having Formula (6) were coated in this order.

(Layer 1) A light-sensitive emulsion layer having Formula (1)

(Layer 2) A hydrophilic colloidal layer 1 having Formula (3)

(Layer 3) A hydrophilic colloidal layer 2 having Formula (4)

(Layer 4) An emulsion protective layer having Formula (2)

The resulting sample was brought into close contact with a step-wedge and was then exposed to 3200K tungsten light for 5 seconds. After that, the exposed sample was processed under the following conditions through a rapid processing automatic processor Model 26SR manufactured by Konica Corp. in which a developer and a fixer each having the following compositions were put.

(Evaluation of Preservability)

The resulting sample was stored under the conditions of 23° C. and 50% RH for 24 hours. After that, it was sealed tight in a package (called Storage I) and was then allowed to stand at 55° C. for 3 days for a substitutional thermal-aging treatment (called Storage II). The resulting sample was exposed to light, developed and fixed in the same manners as mentioned above.

(Evaluation of Ming-Gothic Type Reproduction)

A line original mixed with Ming type and Gothic type letters was photographed on a part of the resulting sample and the sensitivity and Ming-Gothic type reproduction were each evaluated. By making use of another part thereof, a screen-image enlarging photograph (a 10% to 200% enlargement) was taken.

(Evaluation of Screen-Image Enlarging)

A Ming-Gothic reproducibility indicates, when a 50 μm-width fine-line Ming type (positive) original is reversed to be a 50 μm-width negative, how thick (in μm) does a blackened portion change from a 50 μm-width white-on-black Gothic type portion. It can be said that the more closer to 50 μm, the more excellent.

The screen-image enlarging was evaluated in the following manner. When an original having a 95% halftone dot area is photographed under the exposure conditions for changing the 95% halftone dot area into 5%, it is evaluated how many percentage does a 49% halftone dot original change. It can be said that the more closer to 51%, the more excellent.

After making the exposure, the process was carried out under the following conditions, <Processing Conditions>

Processing conditions were as follows.

(Formula of Developer)

| | |
|---|---|
| Sodium bisulfite | 40 g |
| N-methyl-P-aminophenol sulfate | 350 mg |
| Disodium ethylenediamine tetraacetate | 1 g |
| Sodium chloride | 5 g |
| Potassium bromide | 1.2 g |
| Trisodium phosphate | 75 g |
| 5-methylbenztriazole | 250 mg |
| 2-mercaptobenzthiazole | 23 mg |
| Benztriazole | 83 mg |

-continued

| | |
|---|---|
| Hydroquinone | 29 g |
| Diisopropyl aminoethanol | 2.3 ml |
| Amine compound Am-1 | 0.5 ml |
| Potassium hydroxide | An amount to make pH of a solution used to be 11.6 |
| When making use the developer, water was added to make | 1 liter |

Amine compound Am-1:

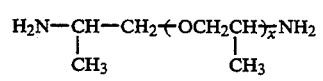

x = 2.6 (in average)

(Formula of Fixer)

| | |
|---|---|
| Ammonium thiosulfate (in an aqueous 59.5% W/V solution) | 830 ml |
| Disodium ethylenediamine tetraacetate | 515 mg |
| Sodium sulfite | 63 g |
| Boric acid | 22.5 g |
| Acetic acid (in an aqueous 90% W/V solution) | 82 g |
| Citric acid (in an aqueous 50% W/V solution) | 15.7 g |
| Gluconic acid (in an aqueous 50% W/W solution) | 8.55 ml |
| Aluminium sulfate (in an aqueous 48% W/W solution) | 13 ml |
| Glutar aldehyde | 3 g |
| Sulfuric acid | An amount to make pH of a solution used to be 4.6 |
| When making use the developer, water was added to make | 1 liter |

(Processing Conditions)

| Processing step | Temperature | Time |
|---|---|---|
| Developing | 38° C. | 20 sec. |
| Fixing | 38° C. | 20 sec. |
| Washing | An ordinary temp. | 15 sec. |
| Drying | 40° C. | 15 sec. |

Each of the processing time included the cross-over time to the next processing step.

Each of the densities of the resulting samples was measured through an optical densitometer Model PDA-65 manufactured by Konica Corp. and the sensitivities thereof were each indicated by a value relative to the sensitivity (regarded as a reference value of 100) of Sample No. 1 obtained when it had a density of 2.5, and the gamma values of the samples were each indicated by a tangent between the densities of 0.1 and 2.5. It was not applicable when a gamma was lower than 6 and it was not satisfactory in a hard contrast property when a gamma was within the range of not lower than 6.0 to lower than 10.0. When a gamma was not lower than 10.0, an ultrahigh contrast image could be so provided as to be satisfactory for practical application.

The results thereof will be shown in Table 1.

TABLE 1

| No | Hydrazin Compound | Redox Compound | Latex | Storage I Gamma | Storage II (Substitutional Aging) Gamma | White-on-color letter | Paste-up trace Sensitivity | Paste-up trace Paste-up trace | |
|---|---|---|---|---|---|---|---|---|---|
| 1 | H-1 | — | Comparative A | 9.0 | 5.4 | 41 | 100 | 60 | Comparative |
| 2 | H-1 | R-1 | Comparative A | 15.2 | 7.3 | 45 | 90 | 57 | Comparative |
| 3 | H-1 | R-1 | L-1 | 15.5 | 15.0 | 49 | 105 | 53 | Invention |
| 4 | H-1 | R-1 | L-3 | 16.0 | 15.8 | 50 | 110 | 51 | Invention |
| 5 | H-1 | R-1 | L-5 | 15.5 | 15.3 | 51 | 115 | 52 | Invention |
| 6 | H-1 | R-1 | L-7 | 15.7 | 15.2 | 50 | 120 | 54 | Invention |
| 7 | H-1 | R-2 | L-1 | 16.8 | 16.0 | 52 | 115 | 52 | Invention |
| 8 | H-1 | R-4 | L-1 | 17.0 | 17.0 | 50 | 113 | 51 | Invention |
| 9 | H-1 | R-6 | L-1 | 16.5 | 16.0 | 50 | 117 | 54 | Invention |
| 10 | H-1 | R-9 | L-1 | 16.0 | 15.5 | 49 | 121 | 53 | Invention |
| 11 | H-2 | R-1 | L-1 | 17.0 | 17.0 | 48 | 109 | 51 | Invention |
| 12 | H-3 | R-1 | L-1 | 18.0 | 17.7 | 49 | 101 | 53 | Invention |
| 13 | H-4 | R-1 | L-1 | 17.2 | 17.0 | 50 | 113 | 52 | Invention |

TABLE 1-continued

| No | Hydrazin Compound | Redox Compound | Latex | Storage I Gamma | Storage II (Substitutional Aging) Gamma | White-on-color letter | Paste-up trace Sensitivity | Paste-up trace Paste-up trace | |
|---|---|---|---|---|---|---|---|---|---|
| 14 | H-5 | R-1 | L-1 | 18.1 | 18.3 | 49 | 105 | 52 | Invention |
| 15 | H-6 | R-1 | L-1 | 17.5 | 17.7 | 50 | 119 | 53 | Invention |

From the result shown in Table 1, samples of the invention are superior in storabilty, Ming-Gothic type reproduction and screen-image enlargement characteristics.

EXAMPLE 2

(Preparation of emulsion)

A silver sulfate solution and a solution which was made by adding hexachlororhodium complex to a solution of sodium chloride and potassium bromide to become $8\times10^{-5}$ mol/Agmol were added simultaneously into the gelatin solution, controlling the flowing quantity. After desalinization, a cubic crystal monodispersed chlorobromide emulsion with a grain size of 0.13 μm containing 1 mol % of the silver bromide was obtained.

After this emulsion was sensitized with sulfur in the usual manner, 6-methyl-4-hydroxy-1,3,3a,7 tetrazaindene as a stabilizing agent and the following additives were added, and emulsion coating solutions E was prepared. Next, the coating solution for emulsion protective layer P, the coating solution for backing layer B and the coating solution for backing protective layer BP were prepared with the following compositions.

(Preparation of the emulsion coating solutions E)

| | |
|---|---|
| Potassium bromide | 5 mg/m$^2$ |
| Compound (a) | 1 mg/m$^2$ |
| NaOH(0.5N) | adjusted to pH 5.6 |
| Tetrazolium Compound | 40 mg/m$^2$ |
| Saponin (20%) | 0.5 cc/m$^2$ |
| Sodium dodecyl benzene sulfonate | 20 mg/m$^2$ |
| 5-methylbenztriazole | 10 mg/m$^2$ |
| Compound (d) | 2 mg/m$^2$ |
| Compound (e) | 10 mg/m$^2$ |
| Compound (f) | 6 mg/m$^2$ |
| Latex of the Invention | 1.0 g/m$^2$ |
| Styrene-maleic acid copolymer (thickener) | 90 mg/m$^2$ |

(a)

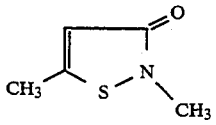

(d)

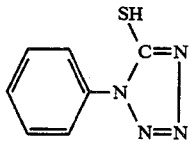

(e)

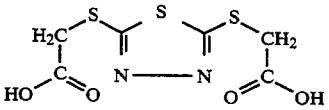

(f)

-continued

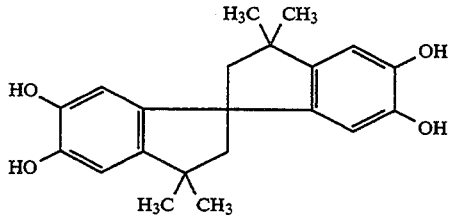

(Preparation of interlayer)

| | |
|---|---|
| Gelatin | 0.5 g/m$^2$ |
| Anti-foggant 5-nitroindazole | 18 mg/m$^2$ |
| Surfactant S-1 | 10 mg/m$^2$ |
| Redox compound of the Invention | $2.0\times10^{-5}$ mol/m$^2$ |

(Coating solution for an emulsion protective layer P)

| | |
|---|---|
| Gelatin | 1.0 g/m$^2$ |
| Compound (g) (1%) | 25 cc/m$^2$ |
| Compound (h) | 40 mg/m$^2$ |
| Compound (k) | 100 mg/m$^2$ |
| Spherical monodispersed silica (8μ) | 20 mg/m$^2$ |
| Spherical monodispersed silica (3μ) | 10 mg/m$^2$ |
| Compound (i) | 100 mg/m$^2$ |
| Citric acid | adjusted to pH 5.8 |
| Styrene-maleic acid copolymer (thickener) | 50 mg/m$^2$ |
| Form aldehyde (hardener) | 10 mg/m$^2$ |

(Coating solution for a backing layer B)

| | |
|---|---|
| Gelatin | 1.0 g/m$^2$ |
| Compound (j) | 80 mg/m$^2$ |
| Compound (k) | 15 mg/m$^2$ |
| Compound (l) | 150 mg/m$^2$ |
| Calcium chloride | 0.3 mg/m$^2$ |
| Saponin (20%) | 0.6 cc/m$^2$ |
| Citric acid | adjusted to pH 5.5 |
| Latex (m) | 300 mg/m$^2$ |
| 5-methylbenztriazole | 10 mg/m$^2$ |
| 5-nitroindazole | 20 mg/m$^2$ |
| Polyethyleneglycol (molecular weight of 1540) | 10 mg/m$^2$ |
| Styrene-maleic acid copolymer (thickener) | 45 mg/m$^2$ |
| Glyoxal | 4 mg/m$^2$ |
| Compound (n) | 80 mg/m$^2$ |

(Coating solution for a backing protective layer BP)

| | |
|---|---|
| Gelatin | amount shown in Table 1 |
| Compound (g) (1%) | 2 cc/m$^2$ |
| Compound (j) | 20 mg/m$^2$ |
| Compound (k) | 4 mg/m$^2$ |
| Compound (l) | 50 mg/m$^2$ |
| Spherical polymethylmethacrylate (4μ) | 25 mg/m$^2$ |
| Sodium chloride | 70 mg/m$^2$ |
| Glyoxal | 22 mg/m$^2$ |
| Bisvinylsulfonylmethylether | 5 mg/m$^2$ |

(g)

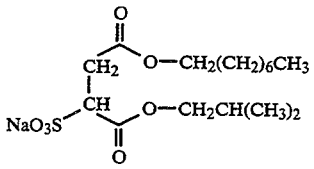

(h)

-continued

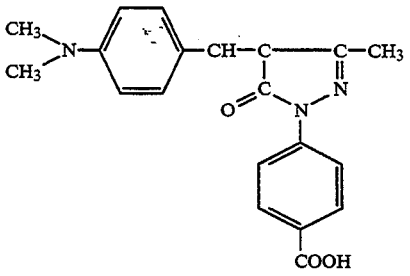

(solid-dispersed dye)

(i)

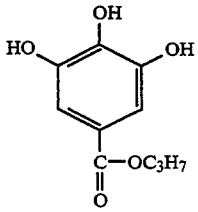

(j)

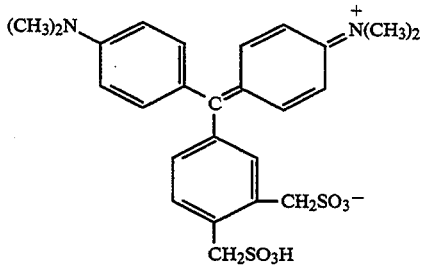

(k)

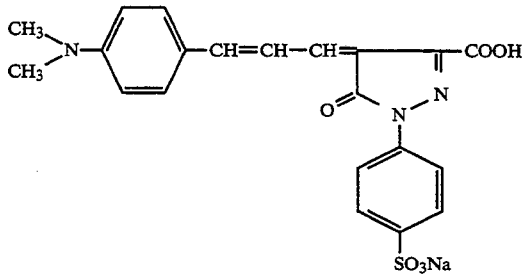

-continued (l)

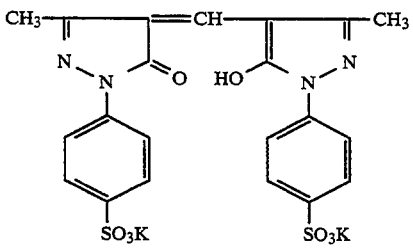

(m)

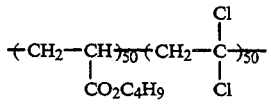

(n)

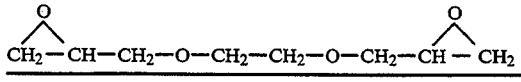

An antistatic layer was provided as follows. On the 100 μ polyethyleneterephthalate base subbed as described in Japanese Patent L.O.P. No. 59-19941 and subjected to corona discharge with 10 W/(m2 min), each coating solution prepared as described above was coated with a roll fit coating pan and an air knife with the following composition so that the coated amount became 10 cc/m$^2$. Then, it was dried at first at a temperature of 90° C. and an overall heat transfer coefficient of 25 Kcal (m$^2$·hour·° C.) for 30 seconds by parallel flowing, and next at a temperature of 140° C. for 90 seconds. The thickness of the layer after drying was 1 μ and the surface resistivity was $1\times10^8\Omega$ at 23° C. and 55%.

| | |
|---|---|
| Water-soluble conductive polymer | 70 g/l |

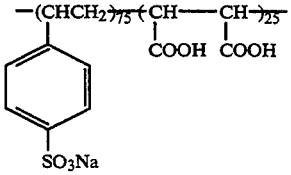

Average Mw = 5000

| | |
|---|---|
| Hydrophobic polymer | 40 g/l |

-continued

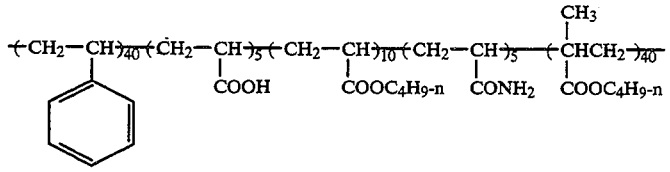

| | |
|---|---|
| Ammonium sulfate | 0.5 g/l |
| Polyethyleneoxide compound (average molecular weight 600) | 6 g/l |
| Hardener | 12 g/l |
| Mixture of | |

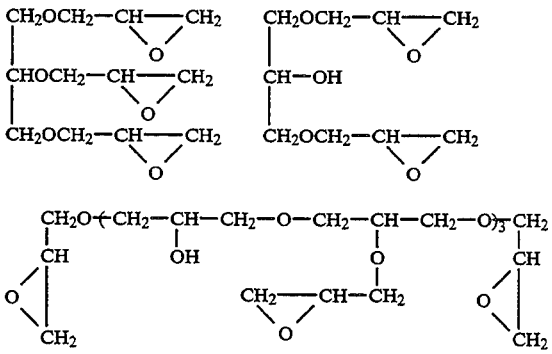

The coating solution for the emulsion layer, an interlayer and that of the emulsion protective layer as prepared mentioned above were coated simultaneously on the support in this order, starting from the support on the emulsion side, adding the hardener solution by the slide hopper method keeping the temperature at 35° C., and the coated material was passed through a cooling set zone at 5° C. The coating solution for the backing layer and that of the backing protective layer were also coated, adding the hardener by the slide hopper method, and the coated material was passed through a cooling set zone at 5° C. After passing each set zone, the coating solution showed sufficient setting characteristics. Both sides were simultaneously dried in the drying zone by the following drying condition. After both sides of the emulsion layer and backing layer were coated, the material was transported by rollers until winding up and with nothing the rest. The coating speed was 100 m/min.

(Drying condition)

The drying air was 30° C. until the ratio of water/gelatin became 800%, and was 35° C. (30%) when the ratio of water/gelatin was reduced from 800% to 200%. The drying was continued until the surface temperature became 34° C. (drying was regarded as finished at this point), and 30 seconds thereafter the drying air with RH 2% was turned to 48° C. for one minute. Drying time was 50 seconds from the beginning of drying to the water/gelatin ratio being 800%, 35 seconds from 800% to 200%, and 5 seconds from 200% to the end of drying.

This light-sensitive material was wound at 23° C. with RH 40%, cut under the same environment, and sealed in a moisture proof bag which was rehumidified for 3 hours under the same environment with cardboard which was rehumidified at 40° C. with RH 10% for 8 hours, and then at 23° C. with RH 40% for 2 hours.

The amount of coated silver in the light-sensitive material made as above was 3.5 g/m$^2$.

The preservability of the sample prepared as mentioned above was evaluated in the same manner as in Example 1. The resulting white-on-color letter and the paste-up trace were also evaluated by making use of the following processing solutions under the following processing conditions.

Exposure Procedures

A non-electrode discharge tube manufactured by Fusion Co. of USA was loaded under a glass plate. An original and a light-sensitive material were superposed on the glass plate surface so that such a paste-up trace as shown in FIG. 1 and a white-on color letter quality can be evaluated, and an exposure was then made.

Photographic Characteristics Evaluation Procedures (1) Paste-up Trace

In FIG. 1, halftone dot film 2 was put on a couple of bases for pasting-up use 3 and 5 and the surroundings of the halftone dot film were fixed by a transparent Scotch tape for plate-making use and then an exposure and a development were made. After that, a series of 5 grade-evaluations were made, in which it was graded as 5 when there was not any tape trace (or any paste-up trace) and as 1 when the trace was so apparent as to be the worst.

(2) White-on-Color Letter Quality

The term, a white-on-color letter quality, herein means an image quality in which a 50 μm-width line can be reproduced on line film 4 shown in FIG. 1, when a proper exposure is so made that a portion having a 50% halftone dot area on halftone dot film 2 shown in FIG. 1 can be a 50% halftone dot area on a light-sensitive material for contact use. A series of 5 grade-evaluations were made, in which it was graded as 5 when providing an excellent white-on-color letter, and as 1 when providing the worst.

In FIG. 1, the numerical indices are;

1: A light-sensitive material for contact use,

2: A halftone dot image film,

3 and 5: Pasting-up bases,

4. A film bearing a line positive image, and
6. A cut-mask film.

500 ml of water so as to make 1 liter, and the pH of the fixer was proved to be about 4.38.

The evaluation results will be shown in Table 2.

TABLE 2

| No | Tetrazolium compound | Redox compound | Latex | Storage I Gamma value | Storage II (Substitutional Aging) Gamma value | White-on-color letter | Paste-up trace | |
|---|---|---|---|---|---|---|---|---|
| 1 | T-2 | — | Comparative A | 8.0 | 3.9 | 2 | 3 | Comparative |
| 2 | T-2 | R-1 | Comparative A | 12.5 | 4.9 | 4 | 1 | Comparative |
| 3 | T-2 | R-1 | L-1 | 13.5 | 13.0 | 5 | 4 | Invention |
| 4 | T-2 | R-1 | L-2 | 14.2 | 14.0 | 5 | 4 | Invention |
| 5 | T-2 | R-1 | L-4 | 15.1 | 14.8 | 4 | 5 | Invention |
| 6 | T-2 | R-1 | L-6 | 13.8 | 13.5 | 5 | 4 | Invention |
| 7 | T-2 | R-3 | L-1 | 14.0 | 18.5 | 5 | 4 | Invention |
| 8 | T-2 | R-5 | L-1 | 14.5 | 14.3 | 4 | 5 | Invention |
| 9 | T-2 | R-7 | L-1 | 13.8 | 13.5 | 4 | 4 | Invention |
| 10 | T-2 | R-8 | L-1 | 13.0 | 13.2 | 5 | 4 | Invention |
| 11 | T-1 | R-1 | L-1 | 14.2 | 14.0 | 5 | 4 | Invention |
| 12 | T-3 | R-1 | L-1 | 15.0 | 14.7 | 5 | 5 | Invention |
| 13 | T-4 | R-1 | L-1 | 14.5 | 14.3 | 4 | 5 | Invention |

| (Standard Processing Conditions) | | |
|---|---|---|
| Developing step | 28° C. | 30 sec. |
| Fixing step | 28° C. | 20 sec. |
| Washing step | Ordinary temp. | 15 sec. |
| Drying step | 40° C. | 35 sec. |

| (Formula of Developer) | |
|---|---|
| (Composition A) | |
| Pure water (ion-exchange water) | 150 ml |
| Disodium ethylenediamine tetraacetate | 2 g |
| Diethylene glycol | 50 g |
| Potassium sulfite (in an aqueous 55% W/V solution) | 100 ml |
| Potassium carbonate | 50 g |
| Hydroquinone | 15 g |
| 5-methylbenzotriazole | 200 mg |
| 1-phenyl-5-mercaptotetrazole | 30 mg |
| Potassium hydroxide | An amount to make pH of a solution used to be 10.9 |
| Potassium bromide | 4.5 g |
| (Composition B) | |
| Pure water (ion-exchange water) | 3 ml |
| Diethylene glycol | 50 mg |
| Disodium ethylenediamine tetraacetate | 25 mg |
| Sulfuric acid (in an aqueous 90% solution) | 0.3 ml |
| 5-nitroindazole | 110 mg |
| 1-phenyl-3-pyrazolidone | 500 mg |

When making use of a developer, the above-mentioned Compounds A and B were dissolved in this order in 500 ml of water so as to make 1 liter.

| (Formula of Fixer) | |
|---|---|
| (Composition A) | |
| Ammonium thiosulfate (converted into 100%) | 168.2 ml |
| Pure water | 5.0 g |
| Sodium sulfite | 5.63 g |
| Sodium acetate.trihydrate | 27.8 g |
| Boric acid | 9.78 g |
| Sodium citrate.dihydrate | 2 g |
| Acetic acid (in an aqueous 90% W/W solution) | 6.4 g |
| (Composition B) | |
| Pure water (ion-exchange water) | 2.82 g |
| Sulfuric acid (in an aqueous 50% W/V solution) | 6.6 g |
| Aluminium sulfate (in an aqueous 8.1% W/V solution having an $Al_2O_3$ converted content) | 26.3 g |

When making use of a fixer, the above-mentioned Compositions A and B were dissolved in this order into From the results shown in Table 2, it was proved that the samples of the invention were each excellent in preservability, white-on-color letter quality and paste-up trace prevention.

According to the invention, a silver halide photographic light-sensitive material for graphic arts plate-making use can be so provided as to be excellent in Ming-Gothic type reproduction, screen-image enlarging and screen-image reduction aptitudes, white-on-color letter quality, paste-up trace prevention, easy handling and stability.

I claim:

1. A silver halide photographic light-sensitive material comprising a support and a light-sensitive silver halide emulsion layer wherein said silver halide photographic light-sensitive material comprising a latex prepared in the presence of added gelatin during or after polymerization of the latex and a redox compound from which a development inhibitor is released when said redox is oxidized during developing process.

2. A silver halide photographic light-sensitive material of claim 1, wherein the silver halide photographic light-sensitive material comprises a hydrazine compound of Formula (H).

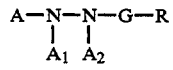

Formula (H)

wherein A represents an aryl group or a heterocyclic group containing at least one sulfur or oxygen atom; G represents $-(CO)_n-$ group, a sulfonyl group, a sulfoxy group,

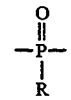

group or an iminomethylene group; n is an integer of 1 or 2; $A_1$ and $A_2$ represent each a hydrogen atom or a hydrogen atom for one and a substituted or unsubstituted alkylsulfonyl or acyl group for the other; R represents a hydrogen atom, or an alkyl, aryl, alkoxy, aryloxy, amino, carbamoyl, oxycarbonyl or $-O-R_4$ group in which $R_4$ represents an alkyl or saturated heterocyclic group.

3. A silver halide photographic light-sensitive material of claim 1, wherein the silver halide photographic light-sensitive material comprises a tetrazolium compound of Formula (T).

Formula (T)

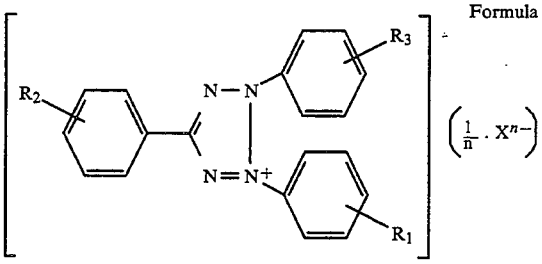

wherein substituents $R_1$, $R_2$ and $R_3$ of the phenyl group of a triphenyl tetrazolium compound represent each a hydrogen atom or a substituent, X is an anion and n is an integer.

4. A silver halide photographic light-sensitive material comprising a support having thereon a light-sensitive silver halide emulsion layer containing a latex prepared in presence of gelatin during or after synthesizing the latex, a non-light sensitive hydrophilic layer containing a redox compound from which a development inhibitor is released when said redox compound is oxidized.

* * * * *